United States Patent [19]

Brooks

[11] 4,437,601

[45] Mar. 20, 1984

[54] ADJUSTABLE WIRE GUIDE

[75] Inventor: Frank W. Brooks, Dayton, Ohio

[73] Assignee: Flexiblast Company, Wilmington, Del.

[21] Appl. No.: 319,823

[22] Filed: Nov. 9, 1981

[51] Int. Cl.[3] ..... B65H 57/00

[52] U.S. Cl. ..... 226/199; 72/428; 242/157 R

[58] Field of Search ..... 226/199, 196, 198; 242/157 R; 72/428

[56] References Cited

U.S. PATENT DOCUMENTS

| | | | |
|---|---|---|---|
| 3,035,464 | 5/1962 | Jacobson | 226/199 X |
| 3,060,773 | 10/1962 | Stroms | 72/428 |
| 3,358,490 | 12/1967 | Heine, Jr. | 72/428 X |
| 3,375,045 | 3/1968 | Zeidler | 226/199 X |
| 4,277,011 | 7/1981 | Jeter | 226/199 |

*Primary Examiner*—Stanley N. Gilreath

*Attorney, Agent, or Firm*—Biebel, French & Nauman

[57] ABSTRACT

An adjustable wire guide for positioning wire within a given range of diameters on a predetermined intended centerline for the wire for feeding the wire into and/or out of equipment which will act upon or process the wire. It includes two pairs of rollers offset in parallel planes with each roller disposed at 90° from an adjacent roller in another plane so that the wire passing through the guide is engaged at four locations equally spaced around it. Each of the rollers is moved through a camming plate and support structure towards or away from the intended centerline of the wire. The movement is achieved simultaneously through the use of spiral slots in the camming plate which receive pins on structural members supporting the rollers and move each of the rollers inward or outward the same amount with respect to the intended centerline of the wire.

5 Claims, 4 Drawing Figures

ADJUSTABLE WIRE GUIDE

BACKGROUND OF THE INVENTION

1. Field of the Invention

The present invention relates to a wire guide apparatus and, more particularly, to a means for centering different diameters of wire on a center line as is commonly required in mechanical wire descaling apparatus and other such devices where a wire must be centered in a particular position for feeding into or out of such apparatus.

2. Prior Art

Common wire guides are usually in the form of a generally cylindrical member formed of hardened steel or the like with a central generally cylindrical but contoured opening, much like a donut-shape, which progresses inwardly to the smallest diameter. This internal diameter is generally only slightly greater than the diameter of the wire to be guided so that it holds the wire as closely as possible to a desired centerline. Such wire guides are usually removably mounted on the entrance and/or the exit of an apparatus through which wire is to be fed. When a different diameter of wire is to be passed through such devices, the wire guide insert is replaced with one of an appropriate diameter to center the wire.

Although these wire guides are generally made of material, such as hardened steel, which is much harder than the wire passing through it, they have a tendency to wear very quickly and thus must be constantly replaced. If they are not replaced soon enough, the wire tends to wear a path through the guide and thus is no longer exactly centered as it enters or leaves the machine. This lack of centering can cause significant problems in the apparatus performing operations on the wire and can lead to breakage in the wire or the equipment.

SUMMARY OF THE INVENTION

The present invention overcomes the above described difficulties and disadvantages associated with prior art wire guide devices by providing a wire guide which is adjustable and utilizes a series of rollers which are simultaneously moved towards or away from the desired center line of the wire so that any diameter of wire will be properly aligned in the wire guide. The use of rollers in the device significantly reduces the wear on the wire guides over those of the fixed type referred to above.

In the present invention, two pairs of rollers are offset in parallel planes with each roller disposed at 90° from an adjacent roller in another plane so that the wire passing through the guide is engaged at four locations equally spaced around it. The guide includes a first pair of rollers mounted for rotation along parallel axes in a common plane perpendicular to the wire which passes between these rollers. A second pair of rollers are likewise mounted for rotation on parallel axes in a separate plane from the first set of rollers, but are positioned 90° around the wire from the locations of the first set of rollers. Thus, the first pair of rollers will contact the wire at points 180° apart, while the second set of rollers will contact the wire at 90° around the wire with respect to the first set of rollers, so that the wire is contacted at four locations 90° from one another.

Each of the rollers is mounted in an assembly which includes a pair of end plates in which bearings are mounted to support each of the rollers for rotation, and a connecting plate interconnecting the end plates which is provided with a camming pin. All of the camming pins of the four guide roller assemblies engage respective arcuate slots in a camming plate. The slots are located symmetrically about the intended center line of the wire and extend generally spirally inward towards the center line of the wire. As the camming plate is rotated the pins cause each of the guide roller assemblies to be simultaneously moved toward or away from the center line so that as the rollers engage the wire, regardless of its diameter, it will be caused to center on the desired center line which will be the same in all cases.

A support structure is provided to keep each of the guide roller assemblies moving in a straight line toward and away from the center line of the wire. The support structure also provides means for attaching the guide to an apparatus into and out of which the wire is to be guided.

Other objects and advantages of the invention will be apparent from the following description, the accompanying drawings and the appended claims.

DETAILED DESCRIPTION OF THE PREFERRED EMBODIMENT

Figure 1:
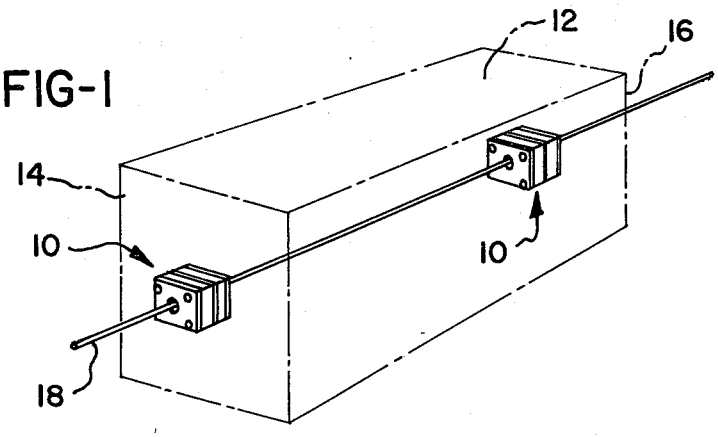
FIG. 1 is a pictorial view of a pair of guide means of the present invention positioned on the input and output ends of an apparatus through which wire is to be drawn and acted upon in some manner.

As illustrated in FIG. 1, the wire guide means 10 of the present invention is intended to be used at both the inlet and outlet of an apparatus 12 which is designed to act on the wire in some manner. The apparatus on which the guide means 10 are mounted is not important with respect to the present invention, but could be, for example, a mechanical wire descaling device such as is disclosed in U.S. Pat. No. 4,175,412. Such a device as 12 is provided with a pair of end walls 14 and 16 through which the wire 18 to be processed must pass. Openings are provided in the end walls 14 and 16 and the wire guide means 10 is secured to each of the end walls 14 and 16 so as to properly position the center line of the wire with the input and output openings in the end walls.

Figure 3:
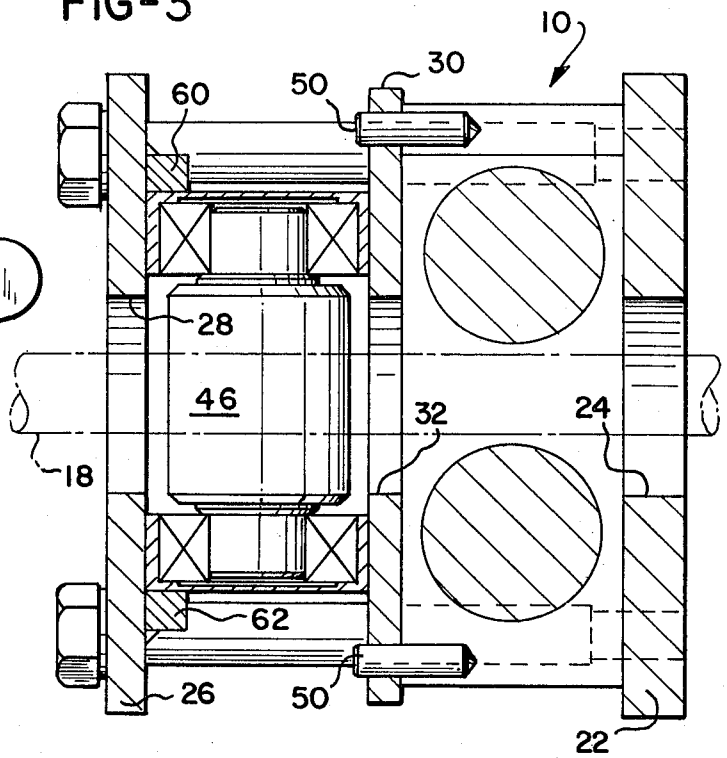
FIG. 3 is a cross-sectional view through the wire guide means of FIG. 2.
Figure 2:
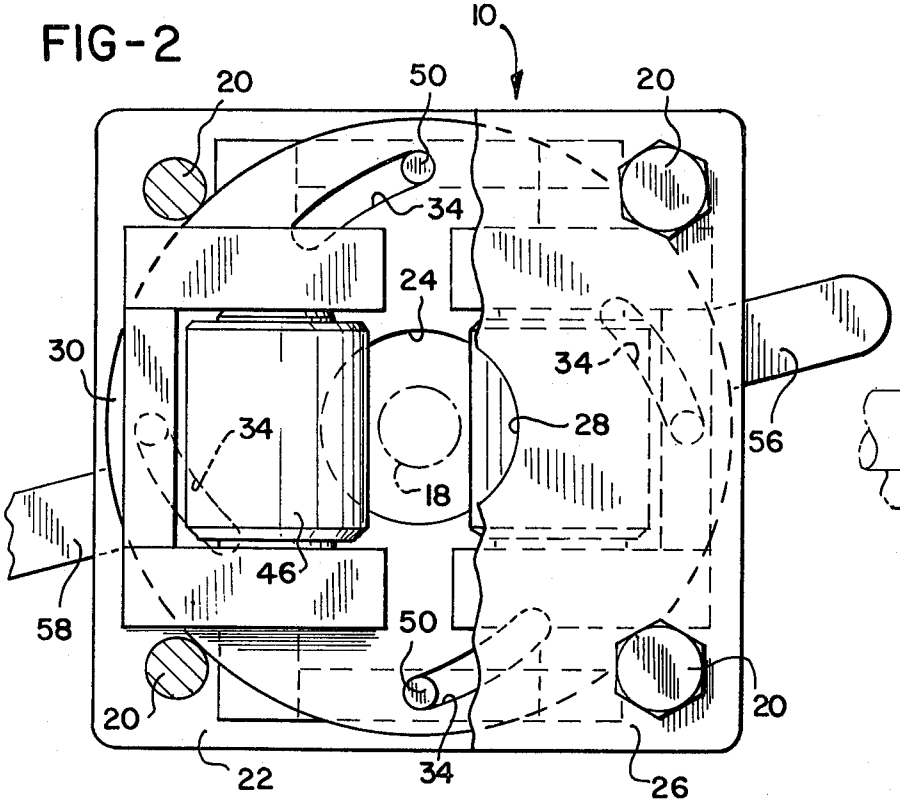
FIG. 2 is an end view of the preferred embodiment of wire guide means of the present invention with the outer plate partially broken away.

Referring to FIGS. 2 and 3, the wire guide means 10 can be fastened to the end walls 14 and 16 with a plurality of bolts 20 which pass through the wire guide means into the end walls.

Each of the wire guide means 10 includes a rectangular base plate 22 which engages the flat end walls 14 and 16 of the device 12. A central opening 24 is provided in the base plate 22, of sufficiently large diameter to permit the wire to pass therethrough. An outer rectangular plate 26 is likewise provided with a circular opening 28 of sufficiently large diameter to permit the wire to pass therethrough unhindered.

A central circular camming plate 30 is positioned between base plate 22 and outer plate 26 and is of a diameter which permits it to rotate freely within the bolt pattern formed by the bolts 20. Camming plate 30 also has a circular opening 32 through which the wire may pass freely. Camming plate 30 also has equally angularly and radially spaced camming slots 34 formed therein which are directed spirally inward towards the center of camming plate 30, which center is coincident with the desired axis of the wire. Slots 34 need not be exactly spiral in their arc, but must progress inward at identical arcs so that all of the rollers, described below, are simultaneously moved an equal amount.

Figure 4:
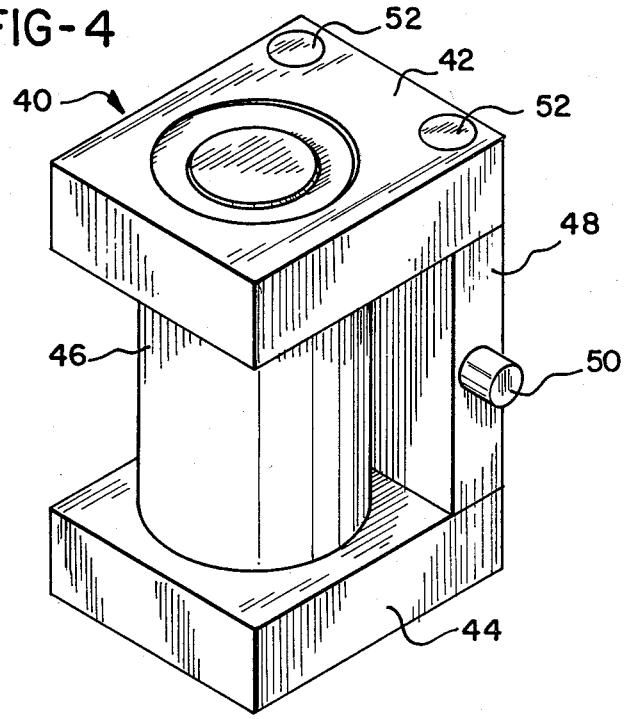
FIG. 4 is a pictorial view of a guide roller assembly utilized in the preferred embodiment of the guide means of the present invention.

A group of four guide roller assemblies 40, one of which is illustrated pictorially in FIG. 4, are contained in each of the wire guide means 10. Each guide roller assembly includes a pair of end plates 42 and 44 in which are mounted bearings to support a guide roller 46. A connecting plate 48 is secured to each of the end plates 42 and 44 and is provided with a camming pin 50. Each of the end plates 42 and 44 are secured to opposite ends of connector plate 48 by bolts 52 to provide a rigid support member for each of the rollers 46. The camming pin 50 can be in the form of a dowel which is either threaded or force fitted into a corresponding opening in connector plate 48.

Four of these guide roll assemblies 40 are then positioned between the base plate 22, outer plate 26 and camming plate 30, as shown in FIG. 3, with the camming pins 50 positioned in corresponding camming slots 34. Thus, there are two guide roll assemblies 40 positioned between outer plate 26 and camming plate 30, and another pair of guide roll assemblies 40 disposed perpendicular to the first two assemblies and sandwiched between base plate 22 and camming plate 30. As camming plate 30 is rotated, for example, clockwise as illustrated in FIG. 2, the four guide roll assemblies 40 will be simultaneously moved inwardly an equal amount so that any wire diameter passing through the guide roll means 10 will be centered on a single central axis.

In order to assist in the manual rotation of the camming plate 30, a pair of lever arms 56 and 58 are secured by welding, or the like, to opposite sides of camming plate 30. If desired, means (not shown) could also be provided for holding the camming plate in a fixed position.

A pair of guide rails 60 and 62 are welded to the inside surface of outer plate 26 for guiding the upper pair of guide roller assemblies 40 as they are moved inwardly and outwardly by camming pins 50. These guide rails maintain the guide rollers 46 with their axes parallel as they are moved inwardly and outwardly by camming plate 30. A similar pair of guide rails (not shown) are welded to base plate 22 and guide the other pair of guide roll assemblies in the same manner.

Thus, it can be seen, that for a given range of wire sizes which will fit within the particular design of the wire guide means 10 of the present invention, each wire diameter will be centered on exactly the same desired central axis as the rollers 46 are moved inwardly or outwardly to engage the sizes of the wire at four different locations separated 90° around the periphery of the wire. The guide rollers 46, which are preferably made from a hardened steel alloy, will thus engage the sides of the wire as it is pulled or pushed through the apparatus 12 and maintain the wire in proper centered alignment regardless of its diameter. Such a device can easily be affixed to many different types of equipment and therefore is not intended to be limited to mechanical wire descaling apparatus of the type referred to as an example herein.

While the form of apparatus herein described constitutes a preferred embodiment of the invention, it is to be understood that the invention is not limited to this precise form of apparatus, and that changes may be made therein without departing from the scope of the invention.

What is claimed is:

1. A wire guide means, comprising:

a frame;

at least two pairs of rollers, each pair being mounted in said frame such that rotational axes of said rollers are parallel to each other and in a plane perpendicular to an intended centerline location of a wire to pass between said rollers of said pairs, said pairs of rollers being disposed in different planes such that said axes of each of said pairs are positioned at spaced angular locations with respect to said axes of others of said pairs about said intended centerline location;

each of said rollers including a rigid support member and a pin projecting from said support member; and a camming plate mounted perpendicular to and for rotation about said intended centerline location, said camming plate having a central opening through which a wire may pass and which is substantially concentric with said intended centerline location, and a plurality of arcuate slots at equal angular and radially spaced locations about said intended centerline location, each of said slots receiving a different one of said pins such that rotation of said camming plate causes equal inward or outward axial translational movement of said rollers with respect to said intended centerline location whereby said rollers may be positioned to engage a wire to position a centerline thereof coincident with said intended centerline location.

2. A wire guide means as defined in claim 1 wherein said slots are generally formed in a spiral arc extending toward said intended centerline location.

3. A wire guide means as defined in claim 1 wherein said frame includes a base plate and an outer plate, both disposed in spaced relation perpendicular to said intended centerline location and each having a central opening through which a wire may pass, said camming plate being disposed between said base and outer plates, a first pair of said rollers being disposed between said outer plate and said camming plate, a second pair of rollers being disposed between said camming plate and said base plate and disposed 90° around said intended centerline location from said first pair of rollers.

4. A wire guide means as defined in claim 3 wherein there are only said first and second pairs of said rollers.

5. A wire guide means as defined in claim 4 including a plurality of guide rail means mounted on said frame and engaging said support members for maintaining translational movement thereof as said rollers are moved toward and away from said intended centerline location.

* * * * *

UNITED STATES PATENT AND TRADEMARK OFFICE

CERTIFICATE OF CORRECTION

PATENT NO. : 4,437,601

DATED : March 20, 1984

INVENTOR(S) : Frank W. Brooks

It is certified that error appears in the above-identified patent and that said Letters Patent is hereby corrected as shown below:

The Assignee's address should be changed from "Wilmington, Del." to --Wilmington, OH--.

Signed and Sealed this

*Twenty-first* Day of *August 1984*

[SEAL]

*Attest:*

GERALD J. MOSSINGHOFF

*Attesting Officer*

*Commissioner of Patents and Trademarks*